US006382729B1

(12) United States Patent
Wu

(10) Patent No.: US 6,382,729 B1
(45) Date of Patent: May 7, 2002

(54) FOLDABLE CHAIR WITH AN INFLATABLE BACK AND SEAT ASSEMBLY

(76) Inventor: Hsin-Tsai Wu, 1F, No. 19, Alley 3, Lane 106, Sec. 3, Min-Chuan E. Rd., Taipei (TW)

( * ) Notice: Subject to any disclaimer, the term of this patent is extended or adjusted under 35 U.S.C. 154(b) by 0 days.

(21) Appl. No.: 09/948,301

(22) Filed: Sep. 7, 2001

(51) Int. Cl.[7] ..... A47C 4/42
(52) U.S. Cl. ..... 297/452.41; 297/16.2
(58) Field of Search ..... 297/452.41, 16.2, 297/45

(56) References Cited

U.S. PATENT DOCUMENTS 3,499,682 A * 3/1970 Ovenstein ..... 297/452.41
4,932,721 A * 6/1990 Anthony ..... 297/452.41
6,161,902 A * 12/2000 Liebermann ..... 297/452.41
6,247,748 B1 * 6/2001 Zheng ..... 297/16.2

* cited by examiner

*Primary Examiner*—Peter R. Brown
(74) *Attorney, Agent, or Firm*—Trop, Pruner & Hu, P.C.

(57) ABSTRACT

A foldable chair includes four legs braced by a stretcher assembly. A flexible sheet member is disposed on and is stretched by top portions of the legs when the stretcher assembly is spreaded. An inflatable back and seat assembly of a single piece construction, is retained removably on the sheet member by means of securing members. When the back and seat assembly is inflated, the expanding force generated as a result of inflation will jerk the top portions of the legs to move apart from one another so as to spread the stretcher assembly.

5 Claims, 6 Drawing Sheets

FOLDABLE CHAIR WITH AN INFLATABLE BACK AND SEAT ASSEMBLY

BACKGROUND OF THE INVENTION

1. Field of the Invention

This invention relates to a foldable chair, more particularly to a foldable chair with an inflatable back and seat assembly mounted removably thereon.

2. Description of the Related Art

Referring to FIG. 1, a conventional foldable chair 1 is shown to include four front and rear right and left legs 11,12 which are braced by four stretcher units 13. A fabric sheet member 15 includes a seat portion 151 which is sleeved on and which is stretched by top coupling members 14 mounted on top ends of the legs 11,12, and a backrest portion 152 which engages and which is stretched by two back upright members 16 extending uprightly from the top ends of the rear right and left legs 12. Although the foldable chair 1 can be folded for facilitating storage and transport thereof due to the fabric sheet member 15, the sheet member 15 may loosen after long-term use, thus resulting in a feeling of discomfort when in use.

SUMMARY OF THE INVENTION

The object of the present invention is to provide a foldable chair which can provide a satisfactory feeling of comfort when in use.

According to this invention, the foldable chair includes a pair of front right and left legs which are spaced apart from each other in a longitudinal direction, and a pair of rear right and left legs which are spaced apart from each other in the longitudinal direction. Each of the front and rear right and left legs has a bottom portion, and a top portion which extends telescopically from the bottom portion in an upright direction. The rear right and left legs are respectively spaced apart from the front right and left legs in a transverse direction relative to the longitudinal direction. A pair of back upright members respectively extend from the top portions of the rear right and left legs in the upright direction. A stretcher assembly includes four stretcher units which are disposed to respectively brace in sequence, four sets of two adjacent ones of the front and rear right and left legs in either one of the longitudinal direction and the transverse direction, and is stretchable between a folded position, where the top portions are displaced in the upright direction to be away from the bottom portions respectively, and where the two adjacent ones of the front and rear right and left legs are disposed to be closer to each other, and a spreaded position, where the top portions are displaced to be closer to the bottom portions respectively, and where the two adjacent ones of the front and rear right and left legs are disposed to be further apart from each other. A flexible sheet member includes a seat portion with four mounting holes to be sleeved respectively on and stretched by the top portions when the stretcher assembly is in the spreaded position, and a backrest portion with two engaging side portions which are disposed opposite to each other in the longitudinal direction and which engage and which are stretched by the back upright members. An inflatable back and seat assembly of a single piece construction, includes a seat body which has a bottom wall with four corner positioning areas that respectively correspond to the mounting holes, and a back body which once inflated, is moved backward to abut against the backrest portion and the back upright members when a user leans on the back body. An air inflating member is disposed to inflate the back and seat assembly. At least two securing members are disposed respectively between the top portions of the front and rear right and left legs and the corresponding corner positioning areas to secure releasably the corner positioning areas to the top portions and to permit the corner positioning areas to be released from the top portions in the upright direction. The back and seat assembly are configured such that when the back and seat assembly is inflated, the expanding force generated as a result of inflation of the back and seat assembly will jerk the top portions of the legs to move apart from one another so as to place the stretcher assembly in the spreaded position, thereby bracing the two adjacent ones of the legs.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
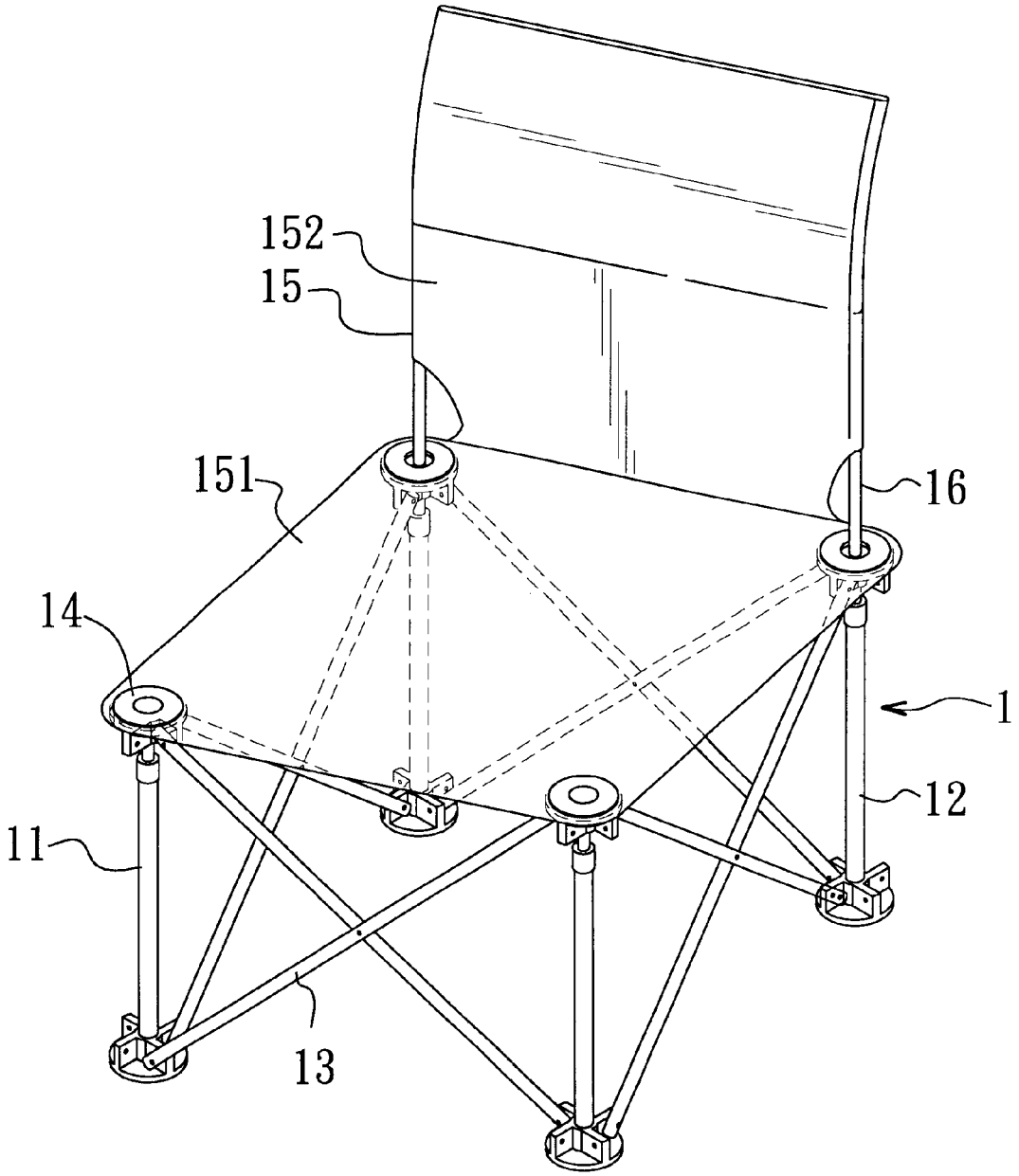
FIG. 1 PRIOR ART
FIG. 1 is a perspective view of a conventional foldable chair in a stretched state.
Figure 2:
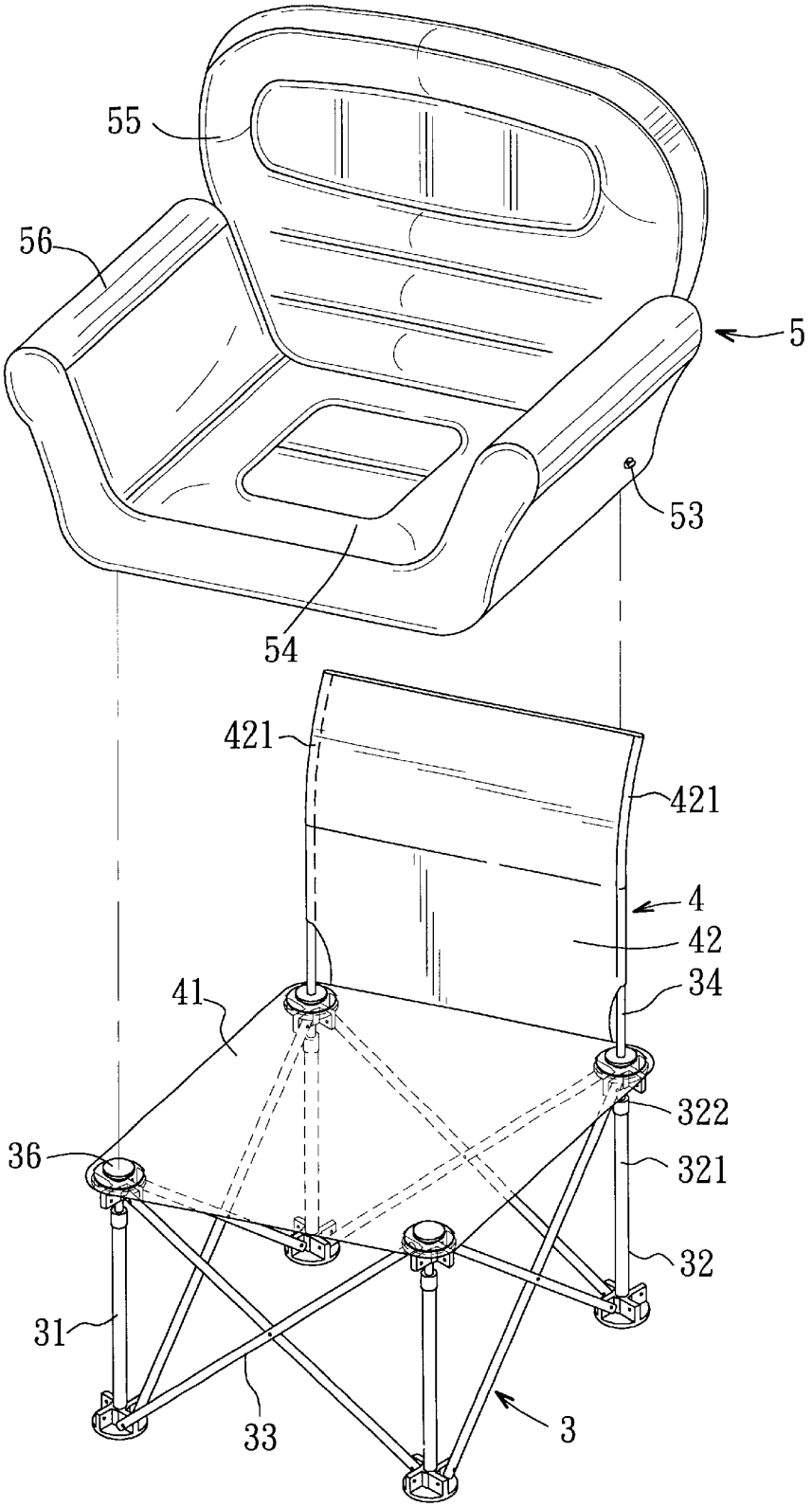
FIG. 2 is an exploded perspective view of a preferred embodiment of a foldable chair according to this invention when stretched.
Figure 3:
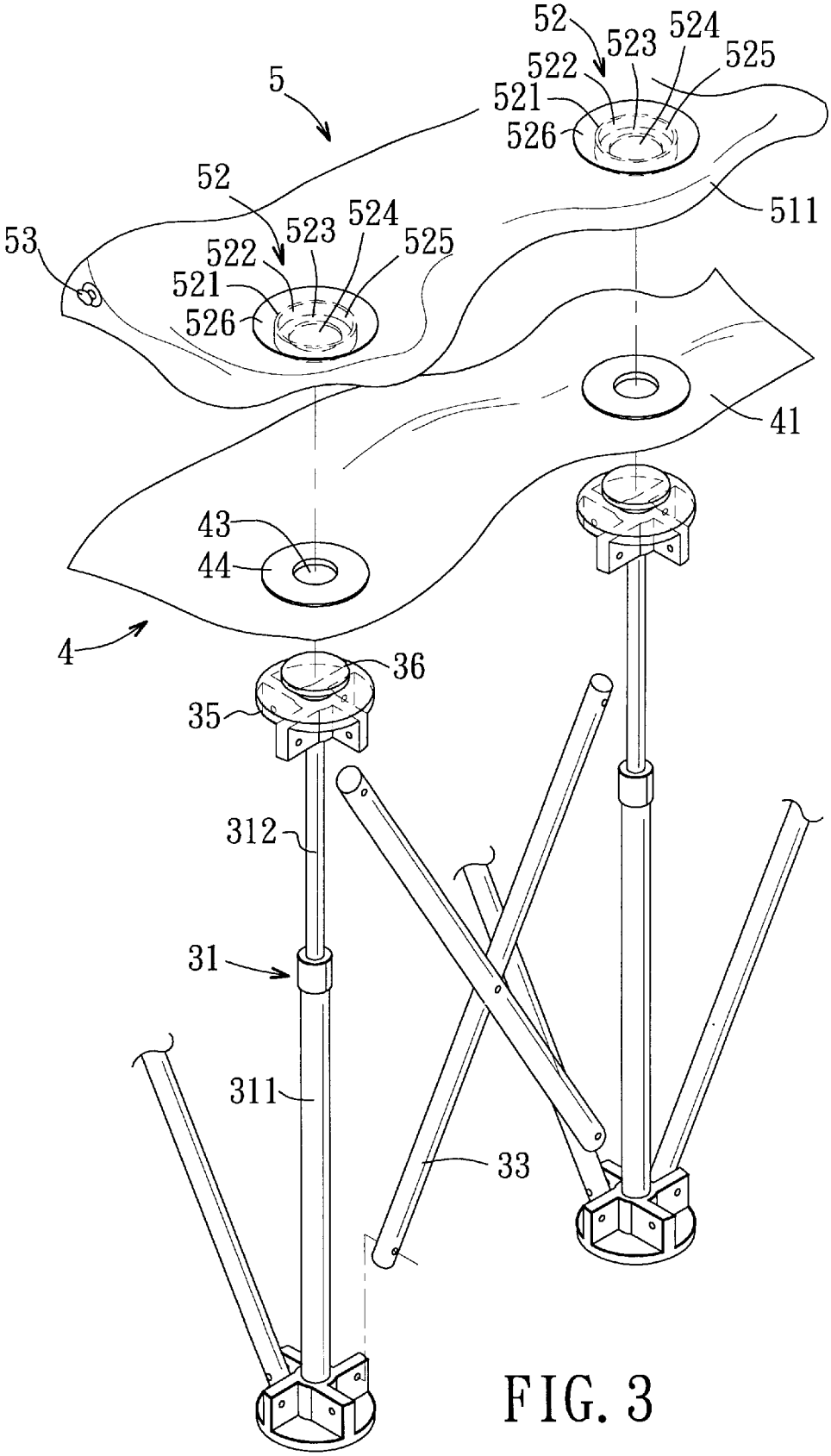
FIG. 3 is an exploded perspective view of a portion of the preferred embodiment.

Referring to FIGS. 2 and 3, the preferred embodiment of the foldable chair according to the present invention is shown to comprise a pair of front right and left legs 31 which are spaced apart from each other in a longitudinal direction, and a pair of rear right and left legs 32 which are spaced apart from each other in the longitudinal direction. Each of the front right and left legs 31 has a bottom portion 311, and a top portion 312 which extends telescopically from the bottom portion 311 in an upright direction. Each of the rear right and left legs 32 has a bottom portion 321, and a top portion 322 which extends telescopically from the bottom portion 321 in the upright direction. The rear right and left legs 32 are respectively spaced apart from the front right and left legs 31 in a transverse direction relative to the longitudinal direction. Four coupling members 35 are sleeved respectively on the top portions 312,322. A pair of back upright members 34 respectively extend from the top portions 322 of the rear right and left legs 32 in the upright direction.

Figure 4:
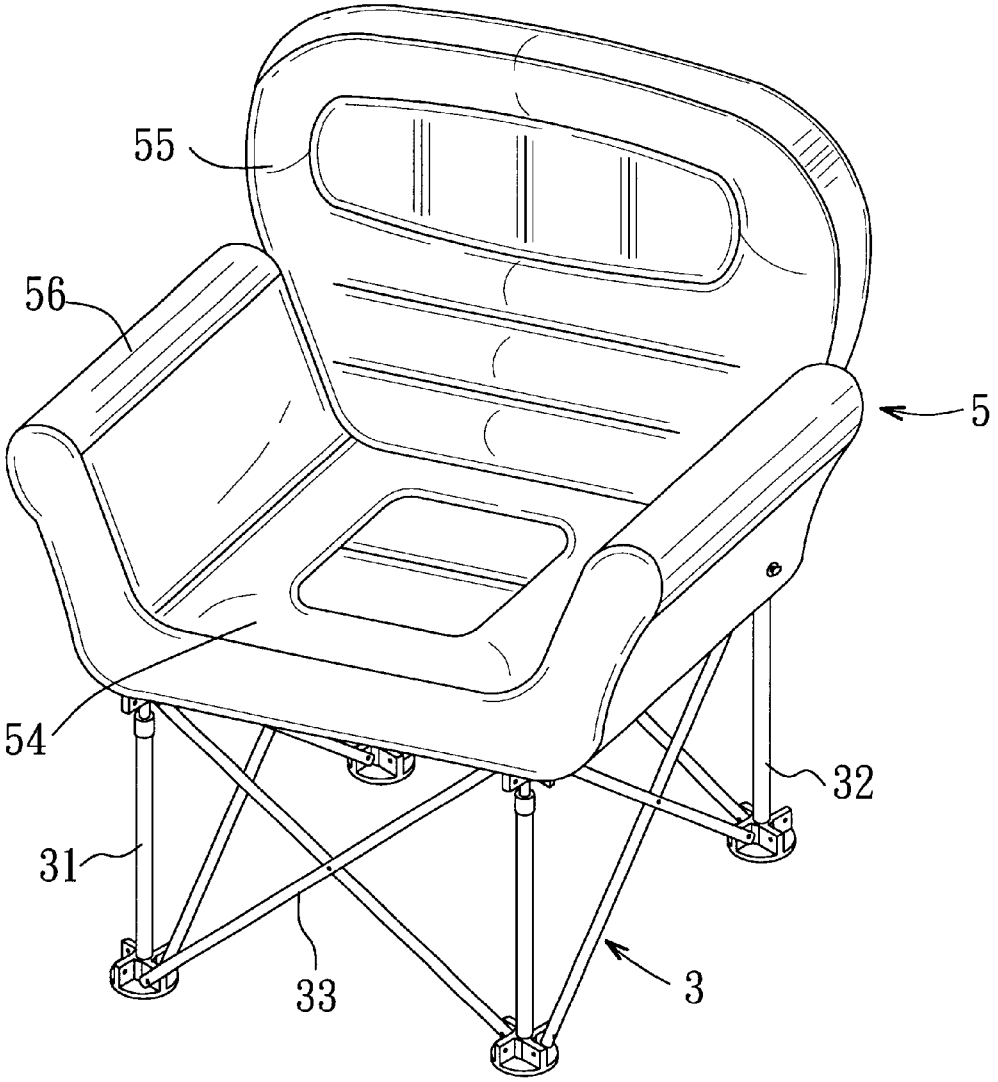
FIG. 4 is a perspective view of the preferred embodiment showing an inflatable back and seat assembly secured on a flexible sheet member.
Figure 5:
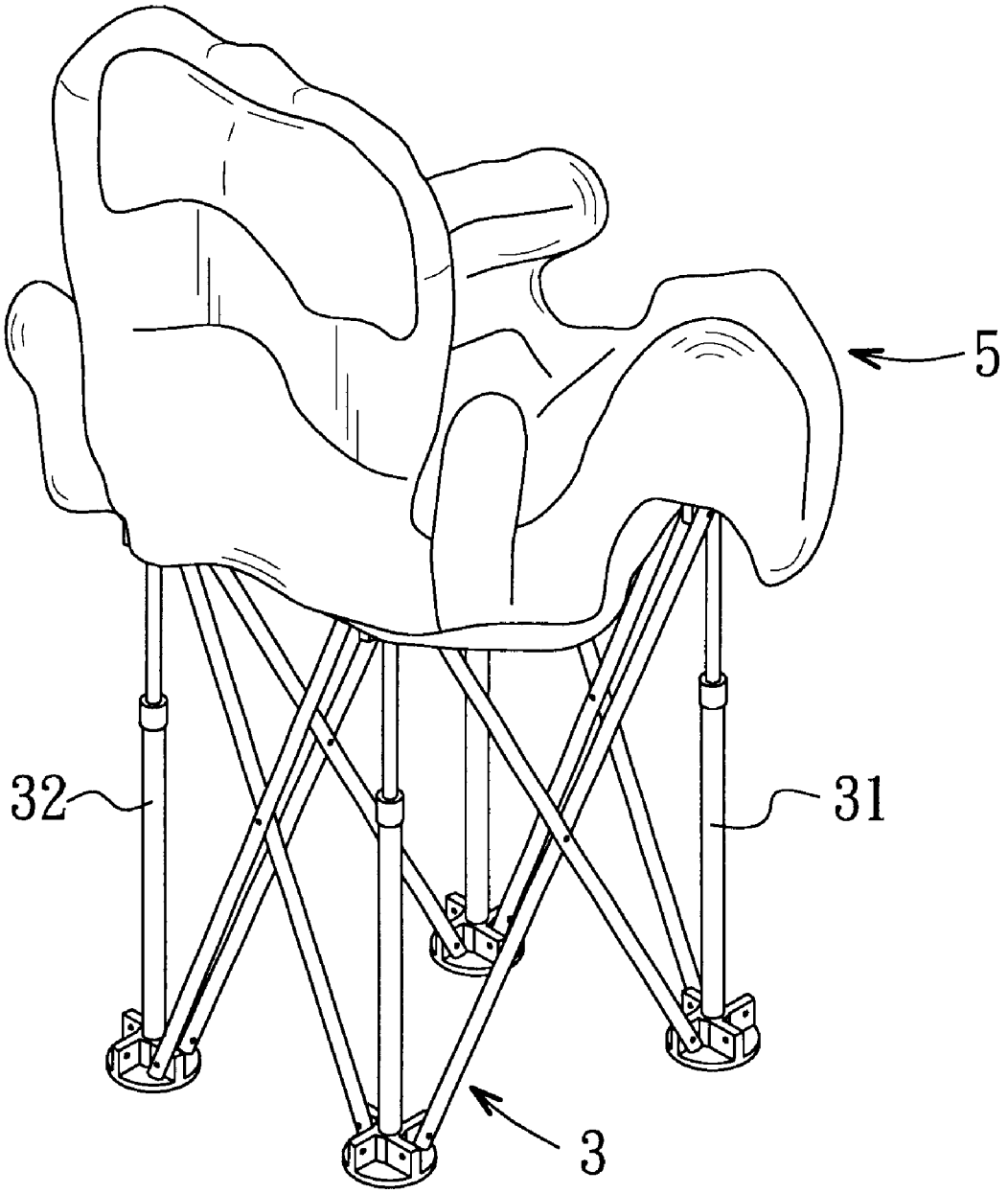
FIG. 5 is a perspective view showing the foldable chair of FIG. 4 in a folded state.

A stretcher assembly 3 includes four stretcher units 33 which are disposed to respectively brace in sequence, four sets of two adjacent ones of the front and rear right and left legs 31,32 in either one of the longitudinal direction and the transverse direction. The stretcher assembly 3 is stretchable between a folded position, as shown in FIG. 5, where the top portions 312,322 are displaced in the upright direction to be away from the bottom portions 311,321 respectively, and where the two adjacent ones of the front and rear right and left legs 31,32 are disposed to be closer to each other, and a spreaded position, as shown in FIG. 4, where the top portions 312,322 are displaced to be closer to the bottom portions 311,321 respectively, and where the two adjacent ones of the front and rear right and left legs 31,32 are disposed to be further apart from each other.

A flexible sheet member 4 includes a seat portion 41 and a backrest portion 42. The seat portion 41 has four mounting holes 43 to be sleeved respectively on and stretched by the coupling members 35 when the stretcher assembly 3 is in the spreaded position, and a backrest portion 42 having two engaging side portions 421 which are disposed opposite to each other in the longitudinal direction and which engage and which are stretched by the back upright members 34 when the stretcher assembly 3 is in the spreaded position. Preferably, four annular members 44 are secured on the seat portion 41, and respectively surround the mounting holes 43 so as to stiffen the seat portion 41.

An inflatable back and seat assembly 5 of a single piece construction, includes a seat body 54 which has a bottom wall 511 with four corner positioning areas that respectively correspond to the four mounting holes 43, and a back body 55 which once inflated, is moved backward to abut against the backrest portion 42 and the back upright members 34 when a user leans on the back body 55. Preferably, two armrest bodies 56 extend from right and left sides of the seat body 54 uprightly. An air inflating member 53 is disposed to inflate the back and seat assembly 5.

Two securing members are disposed between the coupling members 35 on the front right and left legs 31 and the corresponding corner positioning areas of the bottom wall 511 of the seat body 54, respectively. Each securing member includes a socket 52 and a plug 36. The socket 52, which is made of a flexible material, includes a mounting portion 521, an annular wall 522 which, extends downwardly from the mounting portion 521 and which confines an accommodating space 525, and a flexible annular rim 523 which extends inwardly and radially from a lower periphery of the annular wall 522 to confine an opening 524 for the accommodating space 525. Preferably, a rigid annular member 526 is disposed to surround the mounting portion 521 to stiffen the bottom wall 511. The plug 36 is formed integrally with and extends uprightly from the respective coupling member 35, and has such a dimension as to be press-fitted in the opening 524 in the upright direction so as to be retained in the accommodating space 525. In other words, the corner positioning areas can be released from the respective coupling members 35 in the upright direction. Moreover, it is appreciated that when the back and seat assembly 5 is inflated, the expanding force generated as a result of inflation of the back and seat assembly 5 will jerk the top portions 312,322 of the legs 31,32 to move apart from one another so as to place the stretcher assembly 3 in the spreaded position, thereby bracing the two adjacent ones of the legs 31,32.

Figure 6:
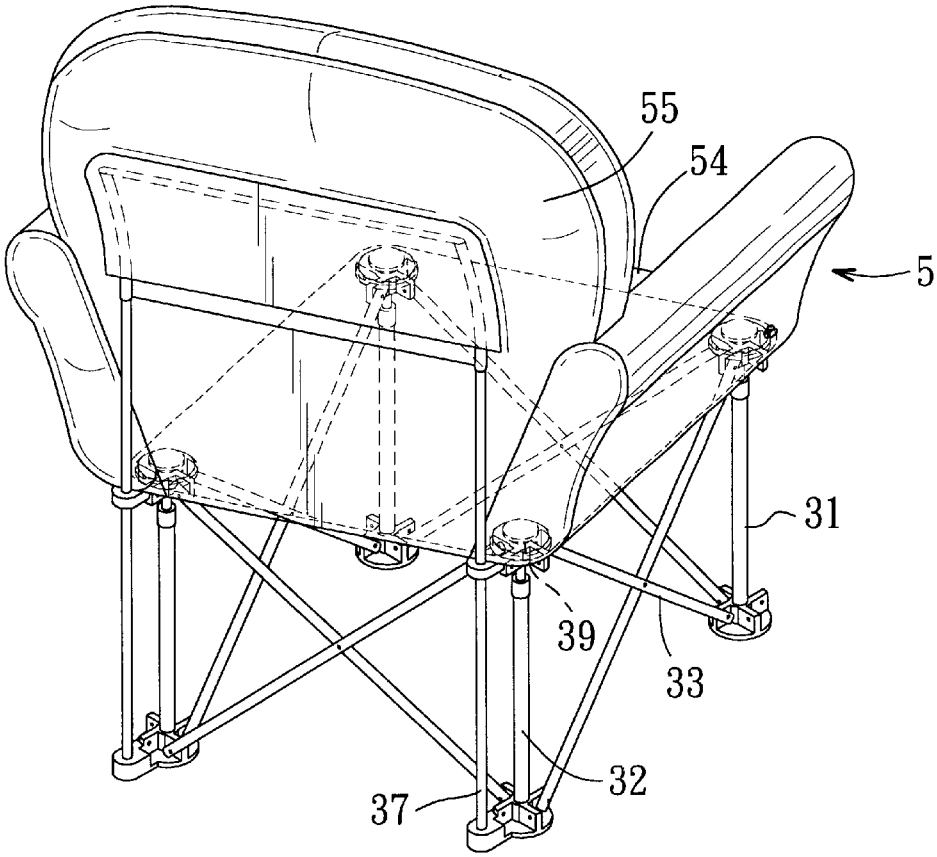
FIG. 6 is a perspective view of another preferred embodiment of the foldable chair of this invention.
Figure 7:
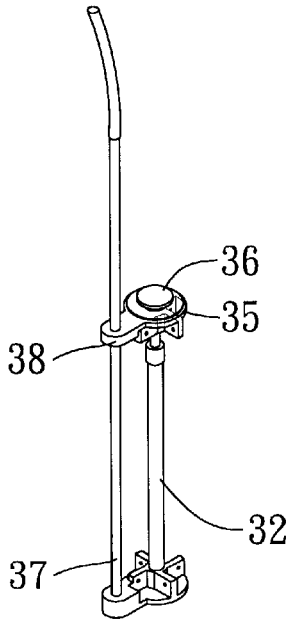
FIG. 7 is a perspective view of a portion of the preferred embodiment shown in FIG. 6.

As shown in FIGS. 6 and 7, another preferred embodiment of the foldable chair of this invention is shown to further include a pair of spacer members 38. Each spacer member 38 has a first end which engages the coupling member 35 on the respective one of the rear right and left legs 32, and a second end which extends rearwardly from the first end and which is sleeved slidably on the corresponding back upright member 37 so as to facilitate mounting of a securing member 39. The securing member 39, which is similar in construction to those disposed on the front right and left legs 31, is disposed between the coupling member 35 on the respective leg 32 and the corresponding corner positioning area of the bottom wall of the seat body 51. In addition, the back upright members 37 extend downwardly from the spacer members 3.8 to engage the bottom portions of the rear right and left legs 32 so as to support the back and seat assembly 5 more firmly when the user leans on the back body 55.

As illustrated, by virtue of the inflatable back and seat assembly 5, the foldable chair can provide a satisfactory feeling of comfort to the user. In addition, when the back and seat assembly 5 is inflated, the stretcher assembly 3 stretches to the spreaded position at the same time, thereby resulting in convenient stretching of the chair.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A foldable chair comprising:

a pair of front right and left legs spaced apart from each other in a longitudinal direction, each of said front right and left legs having a bottom portion, and a top portion extending telescopically from said bottom portion in an upright direction;

a pair of rear right and left legs spaced apart from each other in the longitudinal direction, each of said rear right and left legs having a bottom portion, and a top portion extending telescopically from said bottom portion in the upright direction, said rear right and left legs being respectively spaced apart from said front right and left legs in a transverse direction relative to the longitudinal direction;

a pair of back upright members respectively extending from said top portions of said rear right and left legs in the upright direction;

a stretcher assembly including four stretcher units which are disposed to respectively brace in sequence, four sets of two adjacent ones of said front and rear right and left legs in either one of the longitudinal direction and the transverse direction, and stretchable between a folded position, where said top portions are displaced in the upright direction to be away from said bottom portions respectively, and where said two adjacent ones of said front and rear right and left legs are disposed to be closer to each other, and a spreaded position, where said top portions are displaced to be closer to said bottom portions respectively, and where said two adjacent ones of said front and rear right and left legs are disposed to be further apart from each other;

a flexible sheet member including a seat portion with four mounting holes to be sleeved respectively on and stretched by said top portions of said front and rear right and left legs when said stretcher assembly is in the spreaded position, and a backrest portion having two engaging side portions which are disposed opposite to each other in the longitudinal direction and which engage and which are stretched by said back upright members when said stretcher assembly is in the spreaded position;

an inflatable back and seat assembly of a single piece construction, including a seat body which has a bottom wall with four corner positioning areas respectively corresponding to said mounting holes, and a back body which once inflated, is moved backward to abut against said backrest portion and said back upright members when a user leans on said back body;

an air inflating member disposed to inflate said back and seat assembly; and at least two securing members, each disposed between said top portion of a respective one of said front and rear right and left legs and a corresponding one of said corner positioning areas to secure releasably said corner positioning area to said top portion and to permit said corner positioning area to be released from said top portion in the upright direction, said back and seat assembly being configured such that when said back and seat assembly is inflated, the expanding force generated as a result of inflation of said back and seat assembly will jerk said top portions of said legs to move apart from one another so as to place said stretcher assembly in the spreaded position, thereby bracing said two adjacent ones of said legs.

2. The foldable chair of claim 1, wherein each of said securing members includes a socket secured on a respective one of said corner positioning areas, and a plug projecting from said top portion of the respective one of said front right and left legs in the upright direction and of such a dimension as to be inserted into and retained in said socket in the upright direction.

3. The foldable chair of claim 2, wherein said socket is made of a flexible material.

4. The foldable chair of claim 2, wherein said seat portion of said sheet member has four annular members which are secured thereon and which respectively surround said mounting holes so as to stiffen said seat portion.

5. The foldable chair of claim 2, further comprising a pair of spacer members, each of which has a first end engaging said top portion of a respective one of said rear right and left legs, and a second end extending rearwardly from said first end and engaging a corresponding one of said back upright members so as to facilitate registering of the respective one of said corner positioning areas with the corresponding one of said mounting holes in the upright direction.

* * * * *